United States Patent [19]

Sanders

[11] Patent Number: 4,976,124

[45] Date of Patent: Dec. 11, 1990

[54] WIRE KEY HOLDER

[76] Inventor: Calvin E. Sanders, Rte. 4, Box 367, Lake City, Fla. 32055

[21] Appl. No.: 380,284

[22] Filed: Jul. 17, 1989

Related U.S. Application Data

[63] Continuation-in-part of Ser. No. 903,097, Sep. 2, 1986, Des. Pat. No. 302,280, which is a continuation-in-part of Ser. No. 885,438, Jul. 14, 1986, abandoned.

[51] Int. Cl.[5] ..... A47G 29/10

[52] U.S. Cl. ..... 70/458; 24/3 K; 224/269; D3/103

[58] Field of Search ..... 70/456 R, 457, 458; 224/252, 268, 269; 24/3 K, 230.5 W, 237, 67.9, 546, 547; D19/65; D3/61, 62, 103

[56] References Cited

U.S. PATENT DOCUMENTS

| | | | |
|---|---|---|---|
| D. 302,280 | 7/1989 | Sanders | D19/65 |
| 603,247 | 5/1898 | Becker | 70/458 |
| 1,167,734 | 1/1916 | Anderson | 24/547 |
| 1,340,180 | 5/1920 | O'Brien | 24/547 |
| 1,550,406 | 8/1925 | Wilson | 24/3 K |
| 1,565,501 | 12/1925 | Robinson, Jr. | 24/546 |
| 1,647,390 | 11/1927 | Bailey | 24/3 K |
| 1,689,051 | 10/1928 | Richardson et al. | 224/268 X |
| 1,783,484 | 12/1930 | Ross | 24/547 |
| 2,006,707 | 7/1935 | Bashara | 24/3 K |
| 2,605,632 | 8/1952 | Lamonde | 70/456 |
| 2,633,734 | 4/1953 | Genovese | 70/456 |
| 2,642,638 | 6/1953 | Larrabee | 24/67.9 |
| 2,783,637 | 3/1957 | Brunner | 70/458 |
| 3,777,523 | 12/1973 | Holland | 70/456 R |
| 4,480,356 | 11/1984 | Martin | 24/67.9 |
| 4,523,354 | 6/1985 | Tsukamoto | 24/67.9 |
| 4,612,685 | 9/1986 | Sanders | 24/67.9 |
| 4,658,479 | 4/1987 | Sanders | 24/67.9 |
| 4,847,955 | 7/1989 | Stephens, Jr. | 24/3 K |

FOREIGN PATENT DOCUMENTS

| | | | |
|---|---|---|---|
| 6615445 | 5/1967 | Netherlands | 24/3 K |
| 4724 | 2/1902 | United Kingdom | 24/237 |

*Primary Examiner*—Lloyd A. Gall

*Attorney, Agent, or Firm*—Foley & Lardner, Schwartz, Jeffery, Schwaab, Mack, Blumenthal & Evans

[57] ABSTRACT

A key holder and a method of holding keys is provided wherein the key holder is formed of a single continuous length of multiply-bent wire to define a plurality of legs. The legs form a rectangle/square with an arcuate portion there-behind. Keys are slid between the legs of the arcuate portion and at least one of the legs of the rectangular/square portion to the end of one of the legs. It is then slid onto the rectangular/square portion by sliding onto at least one leg.

9 Claims, 1 Drawing Sheet

WIRE KEY HOLDER

CROSS REFERENCE

This is a continuation-in-part of Design application Ser. No. 903,097, filed Sept. 2, 1986 and issued July 18, 1989 as U.S. Des. Pat. No. 302,280 and application Ser. No. 885,438, filed July 14, 1986 now abandoned.

BACKGROUND OF THE INVENTION

1. Field of the Invention

The present invention relates to an improved key holder.

2. Related Art

The related art is found cited in the above-mentioned design applications and in prior U.S. Pat. Nos. 4,612,685 and 4,658,479, which patents are hereby incorporated by reference.

Prior art key holders are difficult to use, i.e., to slip keys onto without pain or damage to ones fingernails or fingers.

Another problem with the prior art key holders is how to hold the keys, i.e., they must either be placed in a pocket or purse and are thus not readily available and/or uncomfortable in a pocket.

OBJECTS OF THE INVENTION

It is an object of the instant invention to provide a key holder which allows one to slip keys on and off with ease and without pain or damage to one's fingernails or fingers.

Another object is to provide means for "folding" keys into the central portion of the key holder in order to provide a comfortable arrangement for one's pocket.

Still another object is to provide a key holder which can be clipped on the belt of the user and which will be more comfortable and create less noise than the traditional key holders which are more awkward and take up more room and are at times somewhat uncomfortable, as well as being in the way of the user.

Still another object is to provide a key holder which can be snapped onto other existing key holders.

SUMMARY OF THE INVENTION

A key holder and a method of holding keys is provided wherein the key holder is formed of a single continuous length of multiply-bent wire to define a plurality of legs. The legs form a rectangle/square with an arcuate portion there-behind. Keys are slid between the legs of the arcuate portion and at least one of the legs of the rectangular/square portion to the end of one of the legs. It is then slid onto the rectangular/square portion by sliding onto the at least one leg.

BRIEF DESCRIPTION OF THE DRAWINGS

The above and other objects will be seen and better appreciated from the following description and accompanying the drawings wherein.

DETAILED DESCRIPTION OF THE PREFERRED EMBODIMENTS

Figure 3:
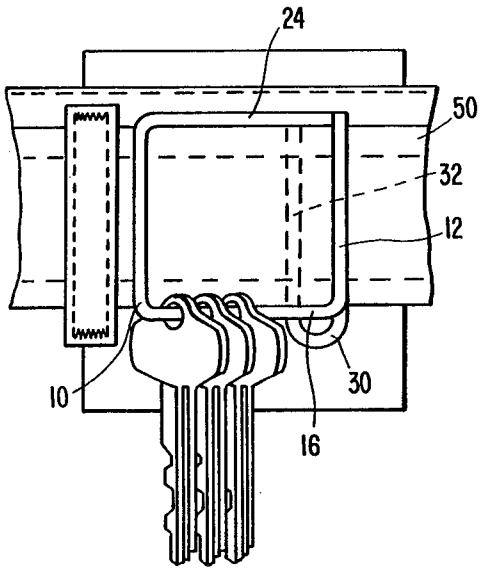
FIG. 3 is a similar elevation view showing the key holder attached to a belt.
Figure 2:
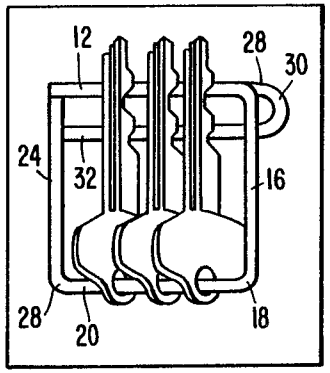
FIG. 2 is a similar front elevation view showing three keys folded inwardly.
Figure 1:
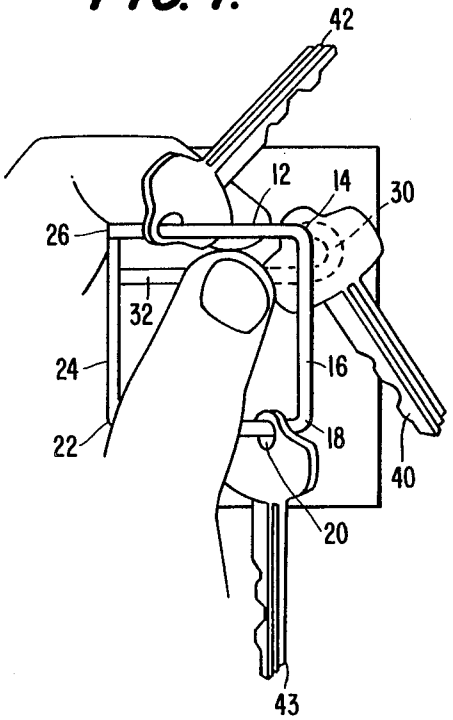
FIG. 1 is a front elevation view of the key holder showing keys being inserted and retained thereon.

The key holder illustrated in FIGS. 1–3 is in the form of a square; however, the same arrangement can be in a rectangle, primarily wherein the unit is "stretched" longitudinally, i.e., to the right and left in the figures.

The key holder comprises a series of legs forming a rectangle or square with an arcuate portion. The holder is formed from a single, continuous length of resilient, heavy gauge wire which can be of the type described in my prior patents and applications.

Extending from one end of the length of the resilient material is a first leg 12 which continues a first distance in a first direction and extends to a first corner 14 wherein it takes a right angle turn forming a second leg 16. At a second corner 18 the resilient material takes another turn forming a third leg 20 which is substantially parallel to leg 12. At a corner 22 the resilient material turns forming a fourth leg 24 which is substantially parallel to leg 16. At a point 26 the resilient material turns and forms a fifth leg 28 behind and substantially parallel and co-planar with leg 12. The wire extends to an arcuate portion 30 wherein it yet forms a final sixth leg 32 which is substantially parallel to legs 12, 20 and 28, as well as co-planar with leg 28. Legs 12 and 32 end substantially at a line colinear with leg 24, thus forming the two ends of the single length of resilient material.

Referring to FIG. 1, with arcuate portion 30 under legs 12, 16 and 24 a person inserts his/her thumb into the opening in the legs and presses lightly on leg 32. A key 40 is placed between the oval or arcuate portion 30 and the legs 12 and 16. The key is then slid along legs 28 and 32 to the end of leg 12 adjacent corner 26. The key is then slid onto leg 12 as seen at 42. It is then slid around to the point seen in FIG. 1 at 43.

The keys can be folded inward as seen in FIG. 2 in order to provide a more comfortable positioning for placing in the pocket.

Finally, the key ring can be slid onto a belt as seen at 50 in FIG. 3. The keys will then hang downwardly as also seen in the figure. The attachment is made by sliding the belt between the oval or arcuate portions 28, 32 and 12, 16, 20, 24.

While specific embodiments of the invention have been described and illustrated, it will be clear that variations in the details of the embodiments specifically illustrated and described may be made without departing from the true spirit and scope of the invention as defined in the appended claims.

What is claimed is:

1. A method of holding keys comprising:

(a) forming a key holder from a single continuous length of multiply-bent resilient material defining two pair of substantially parallel legs forming a rectangular portion, and a third pair of legs substantially parallel to the first pair of legs forming an arcuate portion closely adjacent the second leg, and terminating the first and sixth legs substantially colinear with the fourth leg;

(b) sliding a key over the fifth and sixth legs and between the fifth and sixth legs and at least one of the legs of the rectangular portion and then sliding the key onto said at least one leg.

2. The method of claim 1 including placing a plurality of keys on the rectangular portion and turning them inwardly into the rectangular portion.

3. The method of claim 1 including forming the rectangular portion in the form of a square.

4. The method of claim 1 including placing the key holder on another element by sliding the key holder over said other element wherein the rectangular portion is on one side of said other element and the arcuate portion is on another side of said other element.

5. The method of claim 4 wherein said other element is a belt.

6. A key holder formed of a single continuous length of multiply-bent resilient material to define a plurality of legs, comprising:

(a) two pair of substantially parallel legs, one pair including first and third legs and the second pair including second and fourth legs, said legs forming a rectangular portion, said first leg terminating substantially at a line colinear with said fourth leg;

(b) a third pair of legs formed by fifth and sixth legs substantially parallel to the first and third legs, said fifth leg extending from said fourth leg, said fifth and sixth legs forming an arcuate portion closely adjacent said second leg, said sixth leg also terminating at a line substantially colinear with said fourth leg and extending across said rectangular portion at a distance spaced from said first leg towards said third leg, said distance being less than half-way between said first and third legs wherein a key is slid over said fifth and sixth legs and under said first leg and is then slid onto said first leg.

7. The key holder of claim 6 wherein said rectangular portion is a square.

8. The key holder of claim 6 wherein said rectangular portion and said arcuate portion form means for attaching the key holder to another element.

9. The key holder of claim 8 wherein said other element is a belt.

* * * * *